US006866433B2

(12) United States Patent
Adam

(10) Patent No.: US 6,866,433 B2
(45) Date of Patent: Mar. 15, 2005

(54) PHOTOGRAPHIC PROCESSING

(75) Inventor: Henry H. Adam, Milebush (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/437,196

(22) Filed: May 13, 2003

(65) Prior Publication Data

US 2003/0219249 A1 Nov. 27, 2003

(30) Foreign Application Priority Data

May 21, 2002 (GB) ..... 0211611

(51) Int. Cl.[7] ..... G03D 3/02

(52) U.S. Cl. ..... 396/626; 396/636; 222/94; 222/95

(58) Field of Search ..... 396/617–620, 396/626, 636, 578, 641; 355/27–29; 222/94, 95, 103, 212–215, 107, 145, 129; 220/22

(56) References Cited

U.S. PATENT DOCUMENTS 4,329,042 A * 5/1982 Libicky et al. ..... 396/632
4,941,008 A * 7/1990 Nakamura ..... 396/626
4,961,516 A * 10/1990 Nakamura ..... 396/626
5,353,085 A * 10/1994 Kurematsu et al. ..... 396/626
5,416,551 A 5/1995 Ishikawa et al. ..... 396/626
5,418,592 A * 5/1995 Patton et al. ..... 396/626
5,432,583 A 7/1995 Ishikawa et al. ..... 396/626
5,488,447 A 1/1996 Patton et al. ..... 396/578
5,694,635 A * 12/1997 Earle et al. ..... 396/578

FOREIGN PATENT DOCUMENTS

| | | |
|---|---|---|
| EP | 0 424 820 | 5/1991 |
| EP | 0 727 709 | 8/1996 |
| FR | 2558275 | 7/1995 |
| JP | 7333808 | 12/1995 |

* cited by examiner

*Primary Examiner*—D. Rutledge
(74) *Attorney, Agent, or Firm*—Eastman Kodak Company

(57) ABSTRACT

The invention relates to photographic processing and provides a photographic processing system, comprising one or more processing tanks for processing photographic material. The system also has at least one buffer tank for receiving concentrated replenisher solution from a replenisher solution cartridge. The at least one buffer tank has an outlet in communication with the photographic processing system for direct supply of concentrated replenisher solution to the one or more processing tanks.

7 Claims, 7 Drawing Sheets

20

PHOTOGRAPHIC PROCESSING

CROSS REFERENCE TO RELATED APPLICATIONS

This is a U.S. original patent application which claims priority on Great Britain patent application No. 0211611.9 filed May 21, 2002.

FIELD OF THE INVENTION

The present invention relates to photographic processing. The invention relates in particular to a method and system for photographic processing such as those used to process photographic material e.g. photographic paper or film amongst others. The invention also relates to a cartridge for photographic processing chemicals and to a photographic processing system with which such a cartridge can be used.

BACKGROUND OF THE INVENTION

In the processing of photosensitive material such as film or photographic printing paper, the exposed material is typically conveyed through a series of processing tanks each of which stocks a processing solution to perform a step in the processing. For example, the tanks may contain developer, bleach, fix and water in sequence.

As the photosensitive material passes through each of the tanks, the processing solution in the tank is absorbed into the photosensitive material and is thereby consumed. In addition, the processing solutions are oxidized by air and become exhausted through depletion of active ingredients and build-up of reaction products. Thus, replenishing solutions with the same compositions or more active compositions as or than those stocked in the processing tanks must be supplied. Otherwise, the operation of the processing system will vary with time leading to undesirable variation in the system output.

SUMMARY OF THE INVENTION

According to a first aspect of the present invention, there is provided a photographic processing system, comprising one or more processing tanks for processing photographic material. The system also comprises at least one buffer tank for receiving concentrated replenisher solution from a replenisher solution cartridge. The at least one buffer tank has an outlet in communication with photographic processing system for direct supply of concentrated replenisher solution to the one or more processing tanks.

According to a second aspect of the present invention, there is provided a method of replenishing a photographic processing system having one or more processing tanks. The method includes the steps of supplying concentrated replenisher solution to each of the one or more processing tanks directly from a corresponding one or more buffer tanks. The buffer tanks receive the concentrated replenisher solution from a concentrated-replenisher solution cartridge.

According to a third aspect of the present invention, there is provided a cartridge for photographic processing chemistry. The cartridge comprises a plurality of compressible sections, each section containing a selected concentrated replenisher solution and being adapted for communication with a corresponding one of a plurality of buffer tanks in a photographic processing system.

The invention provides a method and system for replenishing a photographic processing system directly with concentrated replenisher solution. The system comprises buffer tanks to receive the concentrated replenisher solutions that enable conventional direct replenishment processes to be used without the risk of running out of replenisher solution whilst the processing system is in operation.

The invention enables direct replenishment and cartridge replacement without the risk of interrupting replenishment.

In one example of the present invention, compressible cartridges are used to enable substantially all of the contents of the cartridge to be expelled, thus avoiding the problem of extreme pH residues without requiring a complex wash system to wash used cartridges. Used cartridges can therefore be discarded directly without causing undue pollution of the environment.

In one example of the present invention the cartridge is arranged in the photographic processing system such that transfer of the concentrated replenisher solution from the cartridge to the one or more buffer tanks is gravity-assisted. Thus complex valves are not required, since on engagement of the cartridge with the processing system, the concentrated replenisher solution automatically, under the influence of gravity with or without the assistance of additional expulsion means, transfers to the buffer tanks.

BRIEF DESCRIPTION OF THE DRAWINGS

Examples of the present invention will now be described in detail with reference to the accompanying drawings, in which.

DETAILED DESCRIPTION OF THE INVENTION

Figure 1:
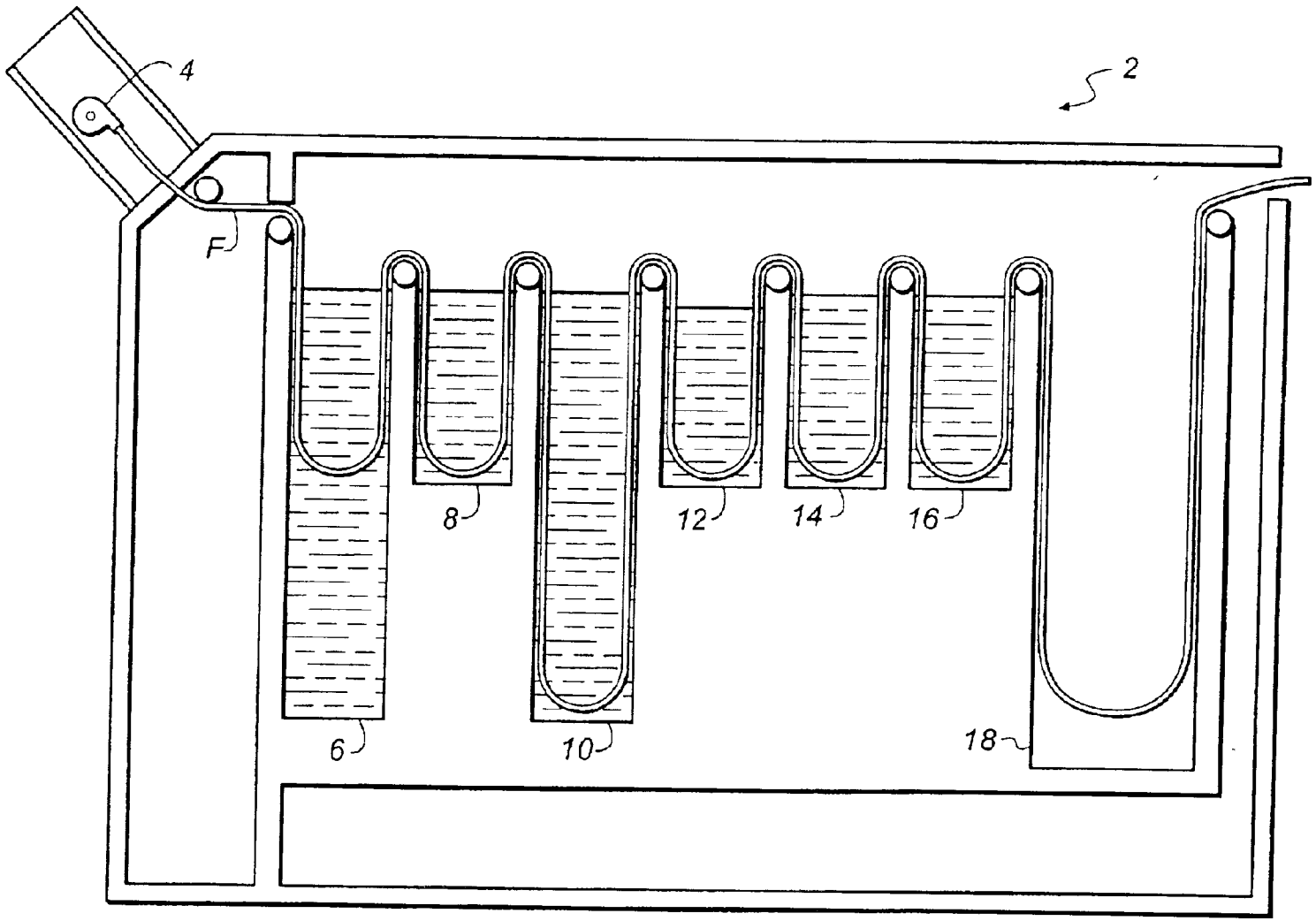
FIG. 1 shows a schematic representation of a photographic processing system according to the present invention.

FIG. 1 shows a schematic representation of a photographic processing system 2 according to the present invention. In this case the system is a film processing system although the invention relates to a system for processing any suitable photographic material. In use of the film developing apparatus, a negative film F is removed from a film cartridge 4. The removed film F is conveyed to a color developing tank 6, a bleaching tank 8, a fixing tank 10, rinsing tanks 12 and 14, and a stabilizing tank 16 in succession. Thus, a sequence of developing steps is performed for the film F. Thereafter, the film F is conveyed to a drying portion 18 so as to dry the film F. Each of the processing tanks, contains a predetermined volume of a respective processing solution.

Figure 2:
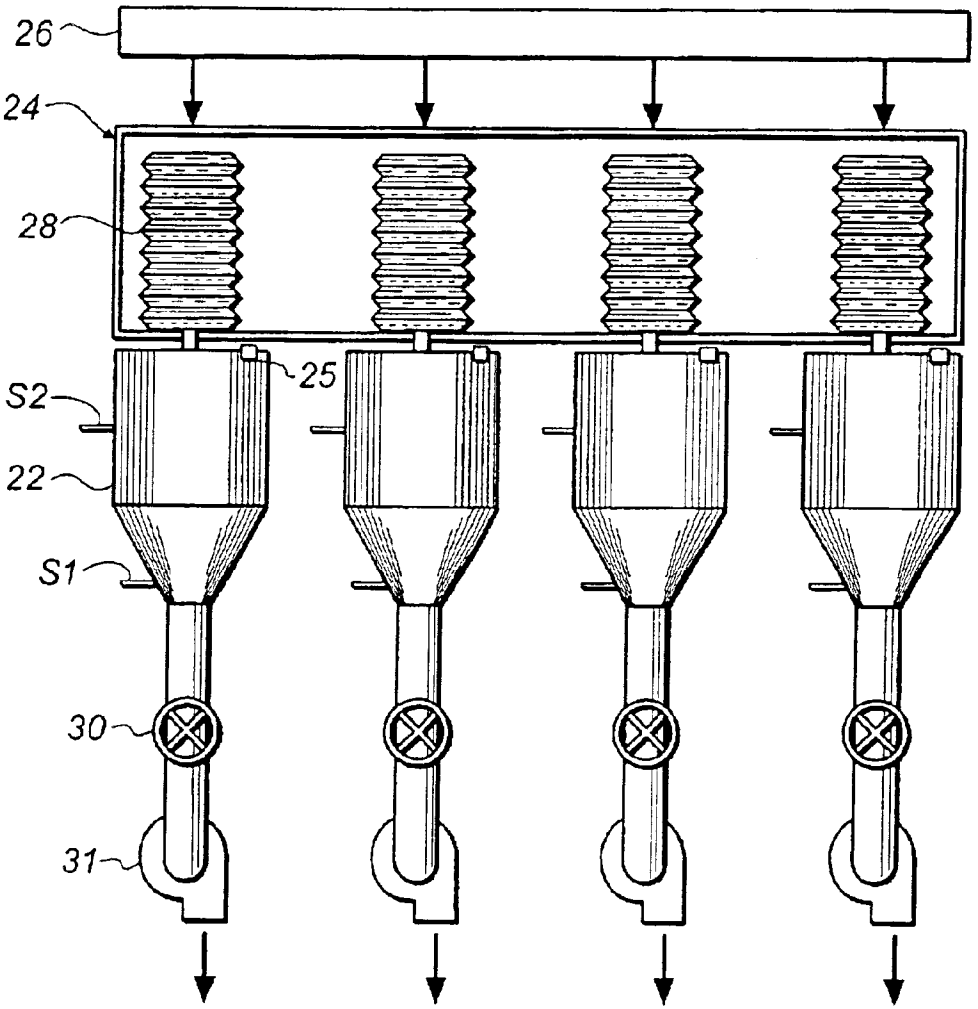
FIGS. 2 to 6 show schematic representations of a replenisher supply system at various stages of a processing cycle for use in a photographic processing system according to the present invention.

FIGS. 2 to 6 show schematic representations of a replenisher supply system 20 at various stages of a processing cycle of a photographic processing system according to the present invention. Referring to FIG. 2, in this example, the supply system 20 has an array of buffer tanks 22. Each buffer tank 22 is adapted to receive a concentrated replenisher solution from a section 28 of a replenisher solution cartridge 24 and to enable controlled flow of the replenishment solution to a respective one or more of the processing tanks 6, 8 and 10. Each buffer tank 22 is provided with sensors S1 and S2 at selected levels within the tank and with venting means 25 to enable equalization of pressure when the concentrated replenishment solution flows to the processing tanks.

The venting means 25 may be a small air vent in the upper surface of each of the buffer tanks. In the case where there is a need to avoid oxidation of the replenishment solution, e.g. in the case of developer replenishment solution, the venting means is a non-return valve between the section 28 and the buffer tank 22. In this case as concentrated replenishment solution flows to the processing tanks, a gas such as nitrogen stored in the respective section 28 occupies the vacated volume from the buffer tank 22.

The replenisher solution cartridge 24 comprises a number of sections 28 each containing one or more concentrated replenisher solutions. For example, one section may contain concentrated developer replenisher solution and another may contain concentrated bleach replenisher solution. Typically, the cartridge has an outer rigid housing containing the sections 28. The sections 28 are preferably formed from a flexible water impermeable material to store the respective concentrated replenisher solution. Alternatively, the material from which the sections 28 are made may be rigid but arranged in a compressible form such as a concertina. It is preferred that the inner surface of each of the sections 28 is hydrophobic to ensure that on compression of the sections, substantially all of the contents are expelled. A hydrophobic material may be used as the wall of each of the sections or alternatively a hydrophobic material may be coated onto the inner surface of the sections 28.

The sections 28 of the cartridges 24 are sized such that the ratios between the volume of each of the concentrated replenishment solutions provided, correspond to the ratios of required replenishment rates for usual processing conditions. In other words, the cartridges are designed so that during normal use, the sections 28 in any one cartridge 24, run out simultaneously. For example, the ratio of volume of any of the different concentrated replenishment solutions e.g. color developer and bleach/fix provided in the cartridge is fixed in dependence on usual replenishment rates for the solutions in any particular process.

The replenisher supply system 20 also comprises expulsion means 26 for ensuring that substantially all of each of the concentrated replenisher solutions is expelled from an opening in each of the respective sections 28 of the cartridge 24. The opening is preferably covered with a friable seal, which is forced open by pressure of the replenisher solution when the sections are compressed by expulsion means 26. In the example shown, the expulsion means is a ram 26 that provides controlled compression of the cartridge 24.

A valve 30 is provided at an exit from each of the buffer tanks 22 to control flow of the respective replenisher solution to the processing tanks 6, 8 and 10 of the processing system. A pump 31 is also provided downstream of each of the buffer tanks 22 to pump the concentrated replenishment solutions to the corresponding processing tanks 6, 8 and 10. A control unit (not shown) associated with the processing system 2 is used to control the operation of the pumps 31 and as will be explained below, control the rate at which solution is pumped from the buffer tanks 22 in dependence on signals obtained from the sensors S1 and S2.

FIG. 2 shows a first stage in the processing cycle of a photographic processing system. The buffer tanks 22 are empty and a full cartridge 24 is placed in communication with them. The volume of each of the sections 28 of the cartridge 24, is sized to correspond to the volume between levels S1 and S2 in each of the buffer tanks 22. The volume of each of the sections 28 of the cartridge 24 may be different but it is preferable that each of the buffer tanks 22 is sized to correspond to the volume of solution stored in the full section 28 to which it is connected.

Figure 3:
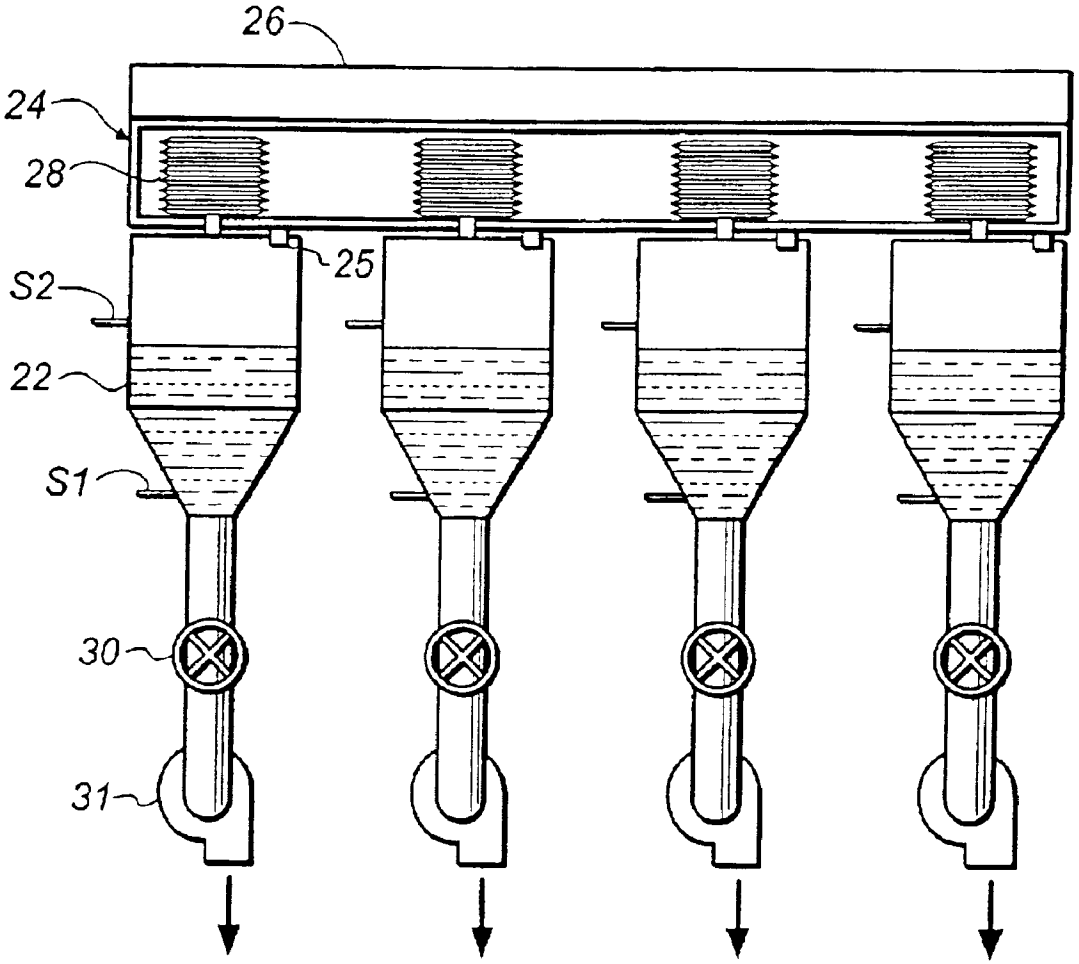

FIG. 3 shows the next stage in the processing cycle of the photographic processing system. The cartridge 24 (and in particular each of the sections 28 therein) is empty due in this case to the combined effect of gravity acting on the contents thereof and the action of the ram 26 that has been driven downwards in the direction of the buffer tanks 22. Each of the sections 28 is preferably formed from a flexible water impermeable material to store a respective replenisher solution. The material is selected such that on descent of the ram 26, each of the sections 28 is compressed thereby ensuring that substantially all of the contents of the section are expelled.

The concentrated replenisher solutions are now stored in the buffer tanks 22. Since there is a small volume between the valves 30 and the level S1, the level of solution in each of the buffer tanks does not reach the level S2.

When a cartridge 24 is emptied, the ram 26 is controlled to ascend automatically, to enable the exhausted cartridge to be removed by an operator. Conversely, when a full cartridge is positioned to enable flow of replenisher solutions into the buffer tanks 22, the ram 26 is controlled to descend automatically, to force the solutions out of the sections 28 (and cartridge 24).

Figure 4:
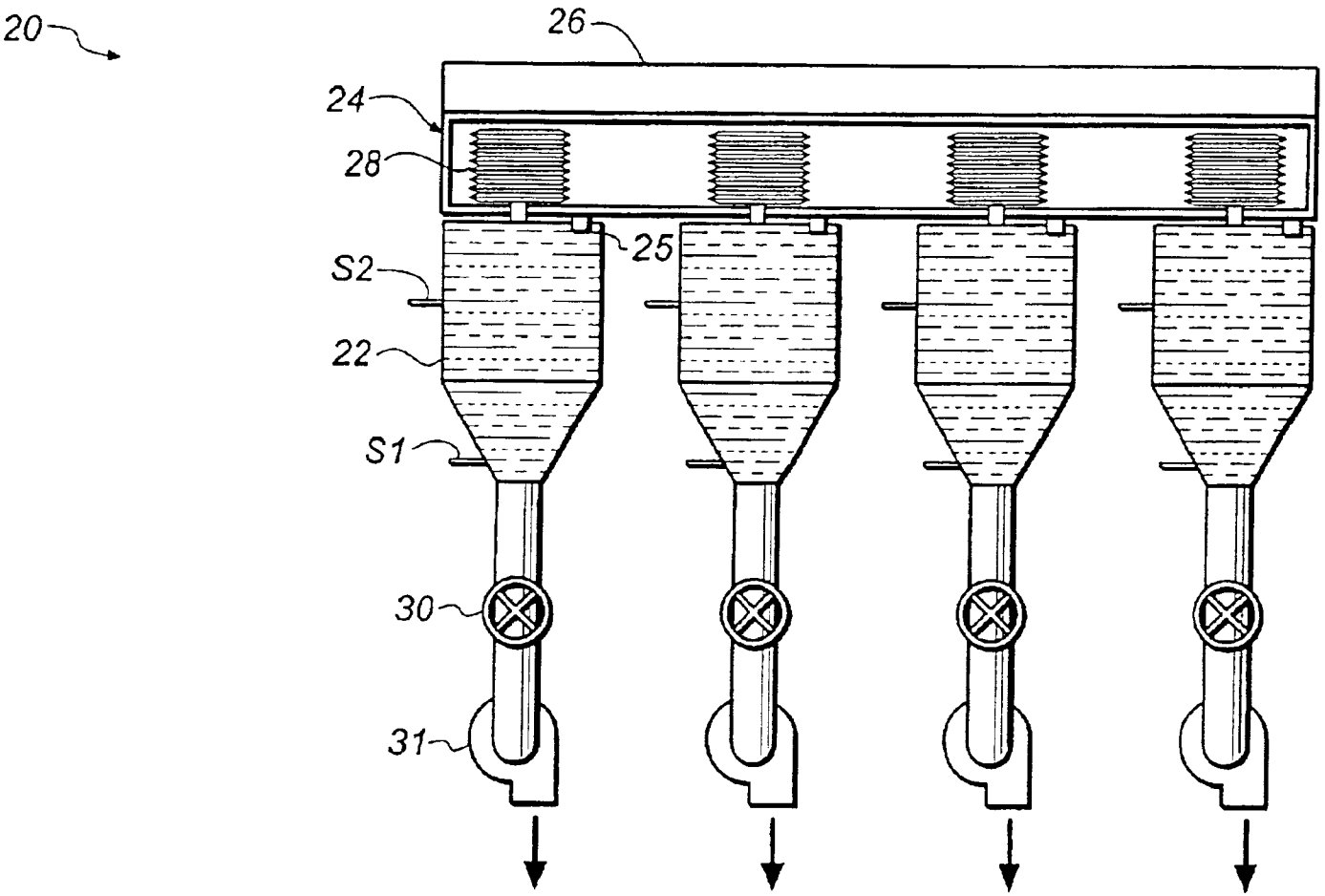

In FIG. 4, a second cartridge of concentrated replenisher solutions has been added to the system 20. Again, via a combination of gravity and the action of ram 26, the contents of the second cartridge are forced into the buffer tanks 22. The level of solution in the buffer tanks 22 now exceeds S2 and the replenisher supply system 20 is now ready for use.

Figure 5:
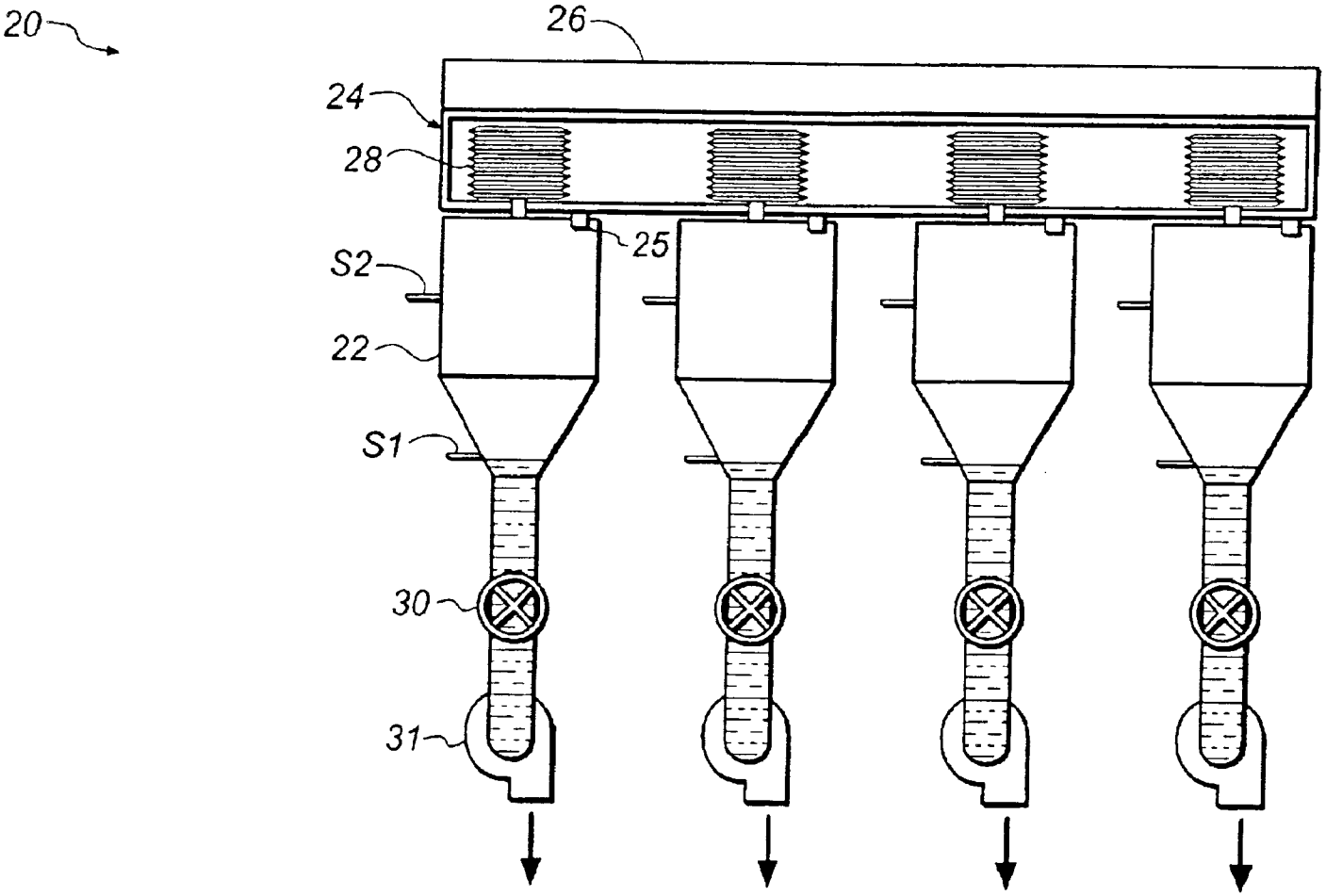

In FIG. 5, the replenisher supply system 20 has been operative for a period of time such that the buffer tanks 22 are almost empty. The level of solution in the buffer tanks is now below S1. The system is configured such that when the level of solution reaches S1, an alarm is triggered alerting an operator to the fact that a new cartridge is required.

As will be explained below, in one example, the processing system is adapted to monitor the rate at which photographic material passes through it in dependence on the rate at which replenisher solution is used. This means that the processing system now knows how much photographic material corresponds to one cartridge of solution.

Figure 6:
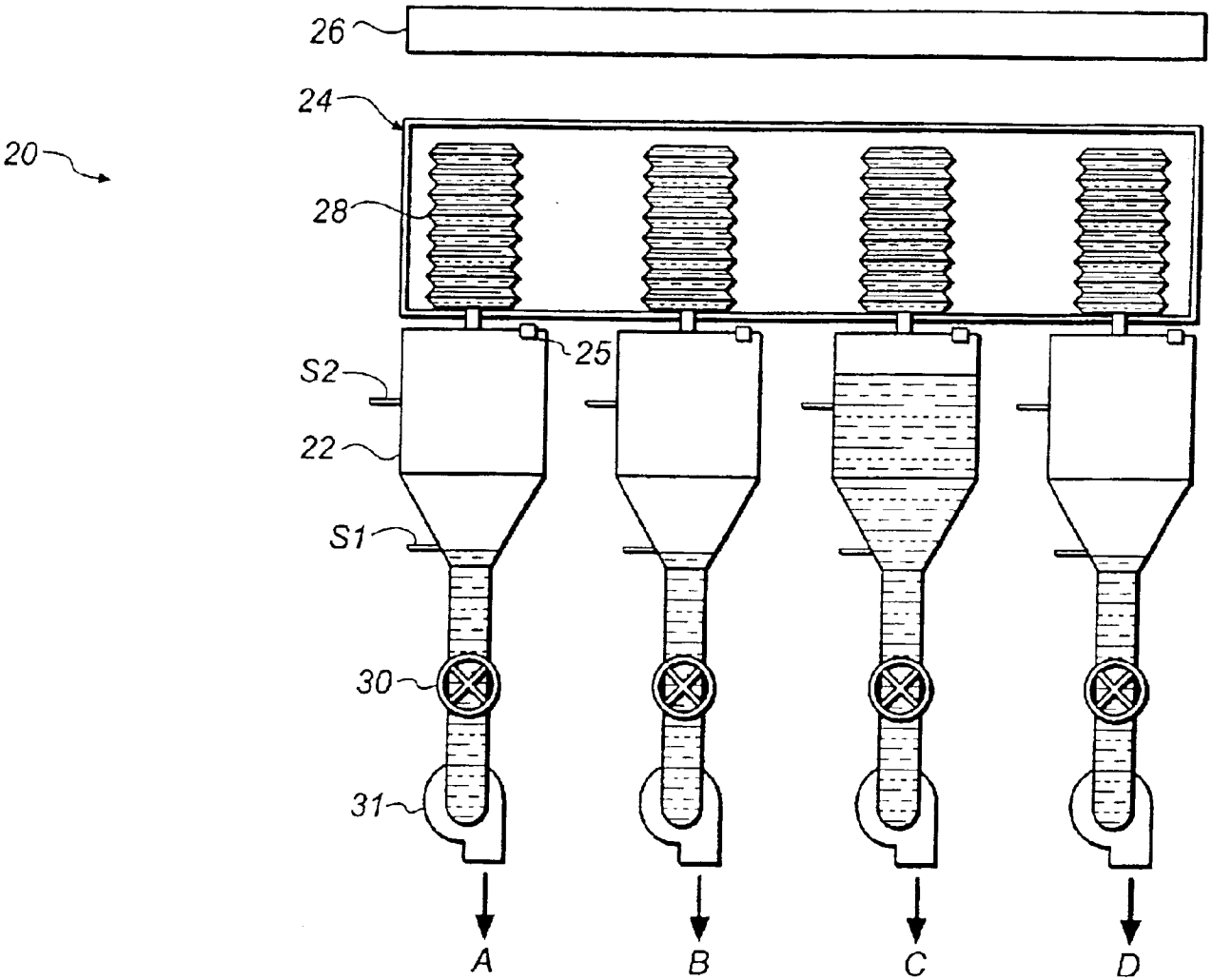

FIG. 6 shows a situation in which a problem has occurred with the processing system 2 and replenisher supply system 20. In this situation, in three out of the four buffer tanks 22 (A, B and D), S1 and S2 are both exposed indicating that a new cartridge is required. However, in the fourth of the buffer tanks (C), both S1 and S2 are still covered. This triggers an alarm (not shown) associated with the processing system 2 to warn an operator of a replenishment fault in line C. The solution in the buffer tank connected to line C is bled off and the cause of the failed replenishment in line C, established and cured.

The replenisher supply system of the present invention enables almost complete emptying of concentrated replenishment solutions from the sections 28. This is achieved by the combined action of gravity acting on the solutions and the compression of the sections 28 by the ram 26. Thus the requirement for washing the sections 28 prior to discarding of the cartridge 24 is overcome. This is desirable due the typically high and/or low pH values for the solutions and substantially reduced volumes of residue.

In addition, since each section 28 (and cartridge 24) is completely emptied when a cartridge is installed, the volume of replenishment solution provided to the buffer tanks and hence the processing system 2, is determined by the volume provided in each of the sections 28. Accordingly, simple flow valves can be used in combination with the replenishment pumps 31 at the outlet from each of the buffer tanks 22.

In one example of the present invention, the replenisher supply system 20 is controlled to provide adaptive replenishment of the processing solution in the tanks 6, 8 and 10 in dependence on signals obtained from sensors S1 and S2 in each of the buffer tanks 22. The method of adaptive replenishment will now be described.

Initially, when the processing system 2 is started up, a new cartridge 24 is engaged with the system 2. Subsequent cartridges are added until both sensors S1 and S2 are covered by the respective concentrated replenishment solutions. As the processing system 2 operates, replenishment solutions are provided to the tanks of the system 2 via pumps 31. Accordingly, the level of solution in each of the buffer tanks 22 decreases. As photographic material is processed and the level of solution in each of the buffer tanks 22 decreases the amount of photographic material that passes through the system 2 is measured. In particular, the amount of material that passes through the system 2 in the time it takes the level of solution to decrease from the level of sensor S1 to that of S2 is determined.

The buffer tanks 22 enable the replenisher supply system to operate as an automatic self correcting replenishment system. Typically, the pumps 31 used to replenish the processing tanks 6, 8, 10 etc . . . require calibration. This must be done by the operator of the processing system 2 on a regular basis to ensure both the correct overall replenishment rate is used and that a correct balance of separate parts is maintained. As explained above, sensors S1 and S2 are provided within each of the buffer tanks 22. The buffer tanks 22 are sized such that they can contain slightly in excess of two cartridge volumes of concentrated replenisher solution i.e. each buffer tank can contain slightly in excess of twice the volume of the corresponding section 28 to which it is coupled. A first one of the sensors S1 is positioned at or near the bottom of a respective one of the buffer tanks 22, such that it triggers a signal when exposed to indicate that the buffer tank 22 is very close to empty. The second one of the sensors S2, is placed above sensor S1 such that the volume of replenisher solution dispensed between exposure of S1 and S2 is defined e.g. it may be equal to a single cartridge volume or a multiple thereof.

During operation, the processing system 2 is controlled by the control unit (not shown), to record the area of photographic material processed. In particular, the system 2 is controlled to determine and record the area of photographic material processed between exposure of sensors S1 and S2. This recorded area corresponds to a defined volume of concentrated replenisher delivered in replenishment. Given a defined volume delivered between exposure of S2 and S1, the control unit is programmed to compare the area of processed material for that volume of concentrated replenisher solution with a theoretically correct area.

If replenishment is greater or less than the ideal, a feedback correction is automatically applied via the motors controlling the replenishment pumps. This is automatically verified for every cartridge (or less) and should a sudden large deviation be found, an operator warning can be given automatically that a replenishment failure has occurred, or is imminent. This ensures accurate replenishment and immediate warning should failure occur. The control unit may be a microprocessor, a computer or any other suitable device, programmed with software to control the system as described above.

As explained above, where the content of a particular section 28 is oxidizable e.g. color developer replenisher, non-oxidizing gas is provided in the section 28 to displace solution when transferred to the respective buffer tank. The cartridge is designed to ensure there is sufficient gas in the section 28 to enable the liquid contents of the section 28 to be emptied into the respective buffer tank 22, without causing the ingress of air. As well as the concentrated developer replenisher, sufficient gas is provided to compensate for at least two volumes of developer i.e. by providing the developer section 28 with a larger diameter than would otherwise be the case.

Figure 8B:
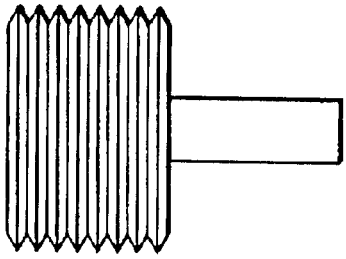
Figure 8A:
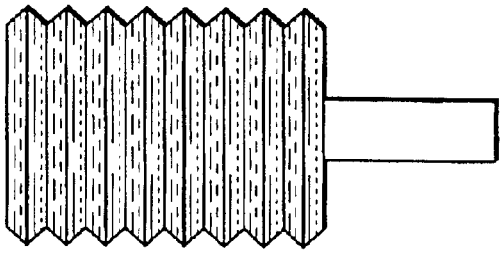
Figure 7B:
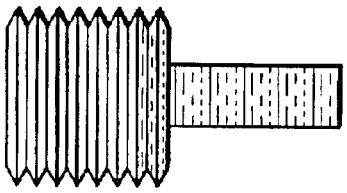
FIGS. 7A and 7B show an example of a section of a replenisher solution cartridge according to the present invention; and, FIGS. 8A and 8B show a further example of a section of a replenisher solution cartridge according to the present invention.
Figure 7A:
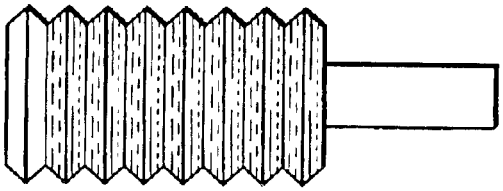

FIGS. 7A and 7B show a schematic representation of a section 28 containing non-oxidizable content in an uncompressed and compressed state, respectively. FIGS. 8A and 8B show a schematic representation of a section 28 containing oxidizable content in an uncompressed and compressed state, respectively. In comparison to the section of FIGS. 7A and B, the section of FIGS. 8A and B has a larger diameter. This ensures that a larger volume of gas such as Nitrogen, Helium or any other suitably unreactive gas, can be stored whilst simultaneously ensuring that the height/compression ratio is the same as for the section of FIG. 7A and B. Most of the gas stored in the section is excluded volume when the section is compressed. A larger volume of gas is required since as explained above, unlike buffers connected to sections storing non-oxidizable solution, buffers connected to sections storing oxidizable solution such as developer replenishment solution are not provided with venting means in communication with the air.

As shown in FIGS. 7B and 8B, the uppermost surface of the sections 28 is preferably made of a flexible material that is able to bulge inwards to allow solution to be withdrawn from the respective section without allowing ingress of air.

It is to be understood that various modifications and changes may be made without departing from the present invention, the present invention being defined by the following claims.

What is claimed is:

1. A photographic processing system, comprising:

one or more processing tanks for processing photographic material; and, a plurality of buffer tanks, each one of which is adapted to receive concentrated replenisher solution from a replenisher solution cartridge for direct supply to a corresponding one of the one or more processing tanks, the replenisher solution cartridge comprising a plurality of compressible sections, each section containing a selected concentrated replenisher solution and being adapted for communication with a corresponding one of the plurality of buffer tanks; and, expulsion means for compressing the cartridge thereby to force the transfer of substantially all the contents of each of the compressible sections to the corresponding buffer tank.

2. A system according to claim 1, in which the expulsion means comprises a ram adapted to compress the cartridge when said cartridge is in communication with the processing system.

3. A system according to claim 2, in which the ram is controlled automatically to compress the cartridge when a cartridge is placed in communication with the processing system.

4. A system according to claim 2, in which the cartridge is arranged in the processing system such that the forced transfer of concentrated replenisher solution from the cartridge to the buffer tanks is gravity assisted.

5. A cartridge for photographic processing chemistry, comprising a plurality of compressible sections, each section containing a selected concentrated replenisher solution and being adapted for communication with a corresponding one of a plurality of buffer tanks in a photographic processing system.

6. A cartridge according to claim 5, in which each section has an opening for connection to the corresponding buffer tank of a photographic processing system, wherein prior to engagement with said photographic processing system the opening is covered by a friable seal.

7. A cartridge according to claim 5 wherein each of a plurality of compressible sections is made of a flexible waterproof material.

* * * * *